US005107644A

United States Patent [19]

Hanig et al.

[11] Patent Number: 5,107,644

[45] Date of Patent: Apr. 28, 1992

[54] FLOOR SUPPORT SYSTEM

[75] Inventors: John A. Hanig, Sheffield; Charles E. Sukup; Steven E. Sukup, both of Dougherty, all of Iowa

[73] Assignee: Sukup Manufacturing Company, Sheffield, Iowa

[21] Appl. No.: 309,513

[22] Filed: Feb. 10, 1989

[51] Int. Cl.[5] ..... E04H 7/00

[52] U.S. Cl. ..... 52/192; 52/508; 52/263

[58] Field of Search ..... 52/302, 303, 145, 192, 52/126.6, 263, 536, 542, 579, 588; 404/36, 41

[56] References Cited

U.S. PATENT DOCUMENTS

| | | | |
|---|---|---|---|
| Re. 31,368 | 9/1983 | Trumper . | |
| 2,901,960 | 9/1959 | Barre et al. . | |
| 3,512,322 | 5/1970 | Steffen . | |
| 4,073,110 | 2/1978 | Kennedy . | |
| 4,282,694 | 8/1981 | Mead . | |
| 4,557,086 | 12/1985 | Liefer et al. . | |
| 4,562,678 | 1/1986 | Carroll et al. . | |
| 4,604,842 | 8/1986 | Sukup . | |
| 4,619,085 | 10/1986 | Carroll et al. . | |
| 4,841,701 | 6/1989 | Sukup | 52/192 X |

OTHER PUBLICATIONS

Sukup Manufacturing Co. Channel-Lok Floors & Supports brochure.

Walsh Grain Bin Floor Supports Specifications brochure.

Cedar Valley Products, Inc. Grain Bin Floor Support Price List.

Walsh Manufacturing Co. 30' Diameter "Free Flow" Installation Sheet.

S & H Mfg. Inc. Floor Supports and Floors brochure.

*Primary Examiner*—David A. Scherbel

*Assistant Examiner*—Wynn Wood

*Attorney, Agent, or Firm*—Leydig, Voit & Mayer

[57] ABSTRACT

An improved grain bin floor support system which utilizes a plurality of floor supports for supporting interlocking floor panels. The floor support is constructed of an upper rail for supporting floor panels, vertical members extending from the upper rail to the foundation of the bin, and a horizontal member which is attached to the vertical members and disposed between the upper rail and the base of the bin. The upper rail has a plurality of recesses and crowns between the recesses. The floor panels have a generally planar top portion and depending flanges which engage in nesting relation with the adjacent flange of the adjacent panel. The depth and spacing of the recesses along the upper rail are such that the floor panels are supported by engagement of the recesses of the upper rail against the depending flanges.

35 Claims, 2 Drawing Sheets

FIG. 1
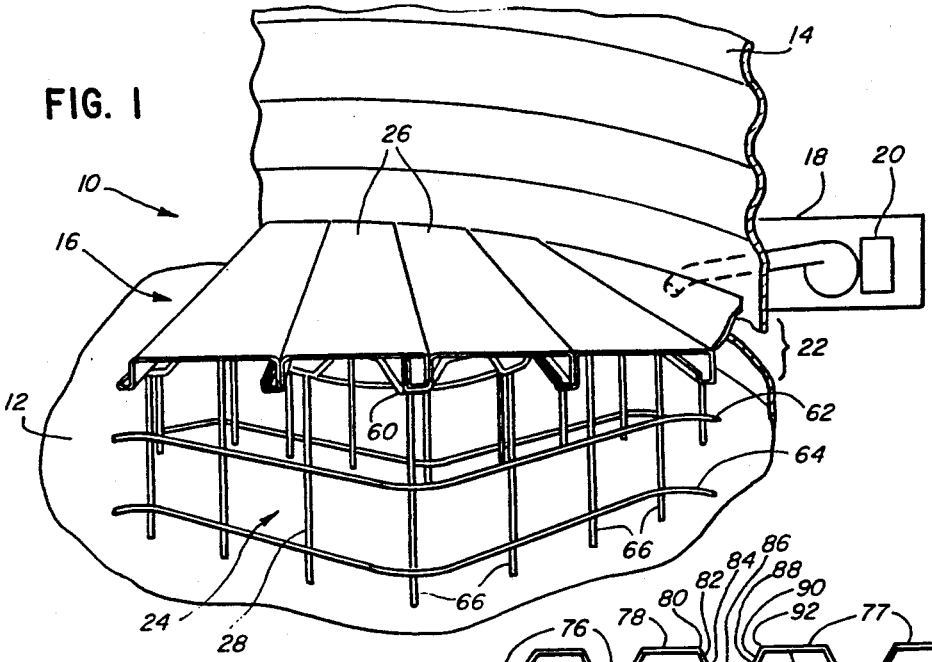
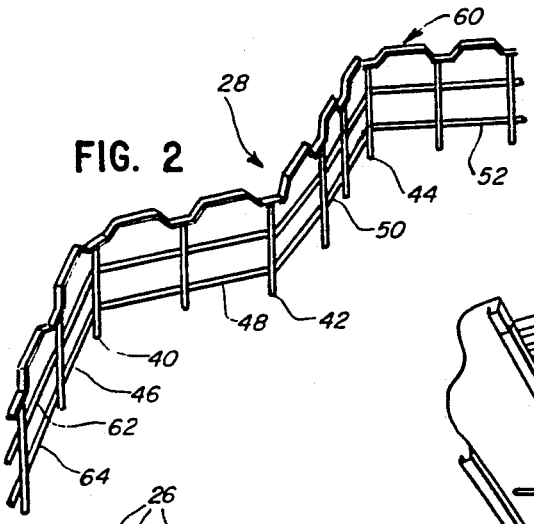
FIG. 2
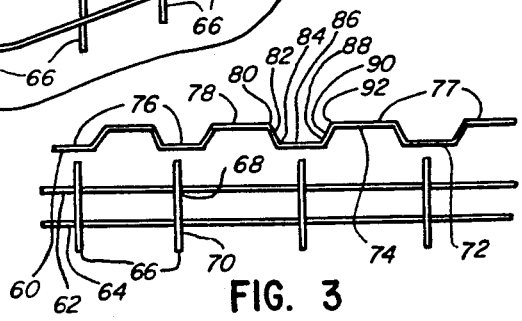
FIG. 3
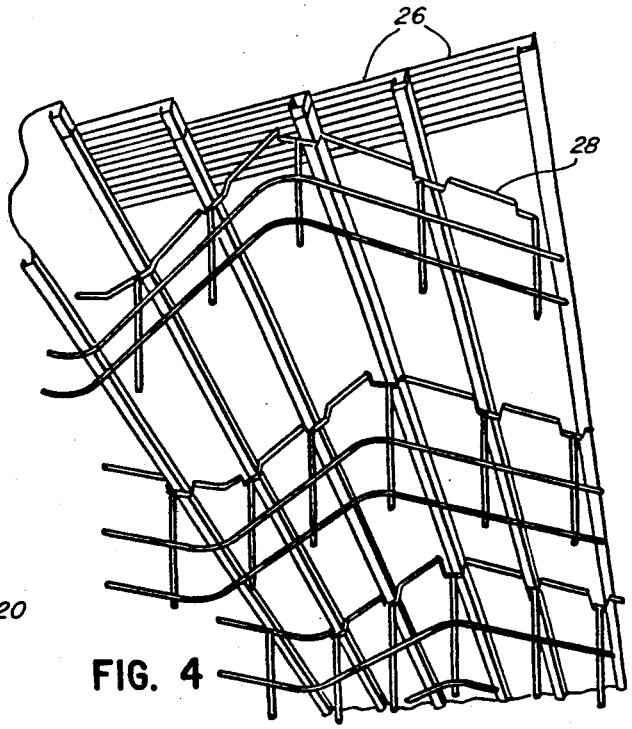
FIG. 4
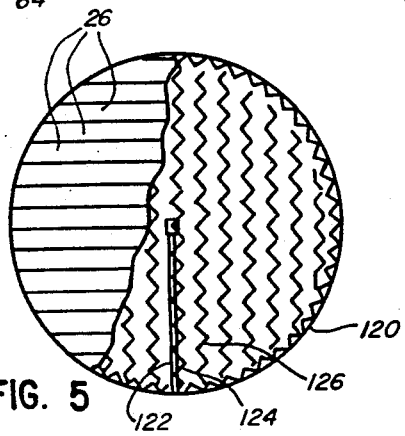
FIG. 5

FLOOR SUPPORT SYSTEM

BACKGROUND OF THE INVENTION

Field of the Invention

This invention relates to supported bin floors and particularly to the floor supports which are used to support sheet metal perforate floor panels to create plenums in grain bins.

Floors which are used in grain storage bins are oftentimes elevated and supported above a base of the bin thereby creating a plenum between the base and the supported floor. The supported floor has perforations through it so that air which may be heated or ambient can be passed from outside the bin in to the plenum and up through the perforations in the floor for passage through overlying grain. The air may be used to dry, cool or otherwise condition overlying grain in the bin, e.g. to prevent subsequent spoilage of the grain. Such bins may serve as drying bins for continuous or batch drying and/or for longer term storage.

Supported bin floors generally include a plurality of longitudinal panels cut to appropriate lengths and arranged side-by-side to substantially cover the entire floor area of the bin. In a common current commercial design of these panels illustrated in FIGS. 1 and 4 hereof, variants of which are disclosed in U.S. Pat. No. 4,604,842, a plurality of similar floor panel sections each have male and female flanges of U-shaped cross sections along opposite edges of the panel so that the male flange of one panel section can be positioned in and interlocked with the female flange of an adjacent floor panel section. Floor supports, e.g., as in FIGS. 1, 4 and 5 hereof, are distributed throughout the plenum. These supports subtend the panels and often engage the outside of the outer flanges. In one embodiment, as shown in U.S. Pat. No. 4,604,842, the supports used are sheet metal posts having outwardly diverging sides with recesses cut into the upper end of both sides so that the panel flanges can be received therein. Other forms of supports are also available. In another floor support system, blocks are placed on the concrete foundation of the bin, onto which are placed the engaged flanges of the floor sections. In another floor support system, a plurality of horizontal grid-iron type frames which are supported by Z-shaped bases form the substructure for the perforated flooring. Other floor support designs include a Z-shaped wire frame support system and a curvilinear floor support system which has a plurality of spacers that extend between upper and lower curvilinear rails.

Among some of the disadvantages of such prior art constructions may be noted lack of strength, cumbersomeness in installation and/or transportation, high materials and manufacturing costs; awkwardness in use and inability to be oriented beneath the grain bin flooring to best possible effect, such as where grain weight may be greatest, or so as to permit an auger to be extended beneath the bin in the airspace occupied by the supports. Further, some kinds of supports can restrict air flow within such air space.

Also, one of the disadvantages of some prior art designs is that only the edge channels of the floor panels contact the floor support. This minimal contact results in the sagging or bending of the center portion of the floor panel or the indentation or bending of the edge channels under heavy load conditions.

One object of the invention is to provide an improved grain bin floor system and particularly a system having an advantageous improved floor support.

Another object of the invention is to provide an improved floor support which is strong and resistant to deformation and bending. The floor support must be able to support great weights when the grain bin is filled with grain.

Another object of the invention is to provide an improved floor support which will stand in its erected orientation by itself without extrinsic support or requiring contact with other supports.

Another object of the invention is to provide a floor support system which permits air to circulate through it very freely and does not restrict the air flow in the plenum.

Another object of the invention is to provide a floor support system wherein the floor panels and the floor supports interlock to facilitate construction and installation of the flooring system.

Another object of the invention is to provide an improved floor support which contacts the floor panels in such a manner that the floor has increased strength and resistance to bending or sagging.

Another object of the invention is to provide a floor support system wherein the floor supports can accommodate several different types of floor panels. For example, floor panels with one outwardly turned channel and one inwardly turned channel or floor panels with two inwardly turned channels or floor panels with two outwardly turned channels could be used alone or in combination.

Another object of the invention is to provide a floor support system wherein the floor supports do not have a configuration which grips or locks onto the floor panel and therefore facilitates easy removal of the floor panels for cleaning or disassembly.

Another object of the invention is to provide a floor support system wherein the floor supports do not have a rail which contacts the concrete base and therefore facilitates easy cleaning of the concrete base.

Another object of the invention is to provide a floor support system wherein the floor supports do not fall or blow over during testing of the air circulation fan or during usage as a grain bin.

Another object of the invention is to provide a new floor support which is easily and inexpensively manufactured of strong low-cost materials and which is rugged, long-lasting and reliable in use.

Further and additional objects of this invention will appear from the following description, accompanying drawings and appended claims.

SUMMARY OF THE INVENTION

The aforementioned requirements and objects are satisfied through a floor support system that is constructed of interlocking perforated floor panels and the floor supports of this invention. The floor supports have vertical bends, i.e. about vertical axes, which thereby become apexes and provide a zigzag configuration to each overall floor support. The bends permit the floor supports to be freestanding during assembly and usage. The upper rail of the floor support is of a broad vertically corrugated configuration, having a series of recesses or valleys which receive the edge channels of the floor panels. The floor supports are positioned below the floor panels and engage the panels at their outwardly turned channels and the plank portions therebetween. Specifically, the edge channels are positioned into the indentations of the floor supports and the intervening central plank portions engage the upwardly protruding elevated plateau or ridge portions between the recesses on the upper rail. This engagement prevents the central plank portions from sagging or bending and also prevents the indentation or bending of the edge channels under heavy load conditions.

DESCRIPTION OF THE DRAWINGS

FIG. 1 is a schematic partial perspective view of a supported floor located in a grain bin and embodying the teachings of this invention;

FIG. 2 is a perspective view of the floor support;

FIG. 3 is an exploded view of the floor support prior to forming the vertical bends;

FIG. 4 is a partial perspective view from the bottom of the grain bin of the floor panels and floor supports;

FIG. 5 is a schematic plan view of a grain bin with portions of the floor panels cut away to show an arrangement of the floor supports of FIG. 2 in the grain bin;

Figure 6:
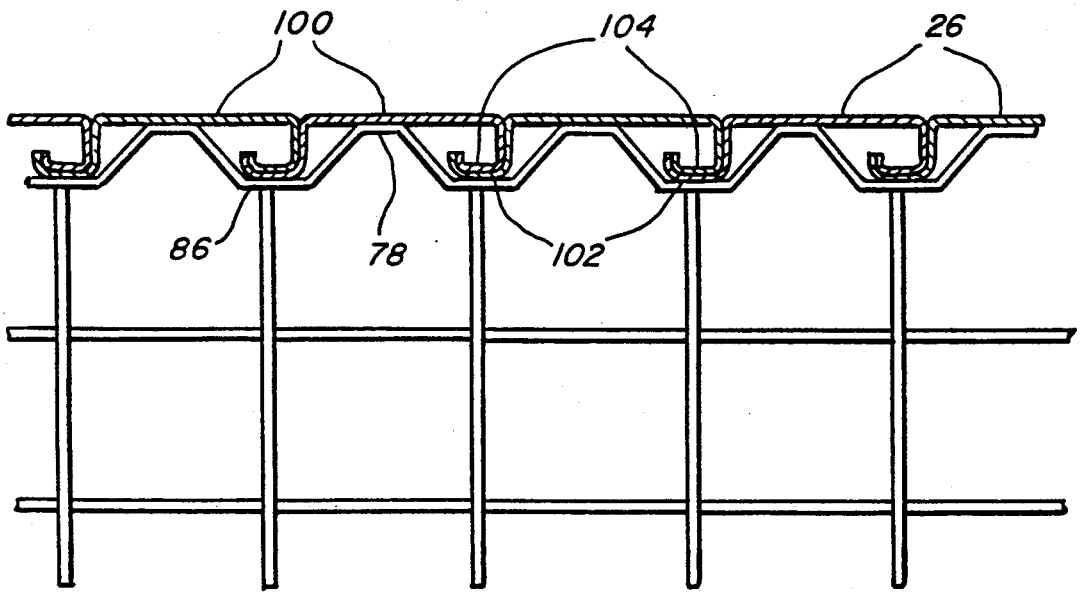
FIG. 6 is a partial sectional view of the floor panels and a floor support.

It should be understood that the drawings are not necessarily to scale and that an embodiment is sometimes illustrated in part by schematic and fragmentary views. In certain instances, details of the actual structure which are not necessary for an understanding of the present invention may have been omitted. It should be understood, of course, that the invention is not necessarily limited to the particular embodiments illustrated herein.

DESCRIPTION OF THE DRAWINGS

FIG. 1 illustrates a partial perspective view of a grain bin 10 having a concrete pad or foundation 12 and a circular wall 14, typically formed of corrugated sheet metal, with the supported grain bin floor system 16 which is the subject of this invention. The supported floor system 16 has floor panels which have perforations to provide for the passage of conditioning air, e.g., drying and/or cooling air. This air is conveyed into the bin by a fan 18, which may include a heater 20 located outside the bin, and enters the bin through a port-hole 22. The air passes into the plenum 24 below the panels 26 and up through the perforations into and through the grain (not shown) stored in the bin on the supported floor system 16. The floor panels 26 are supported by a plurality of floor supports 28.

Referring to FIG. 2, the floor support 28 is of an M configuration having three bends 40, 42 and 44 which are vertical when the floor support is in an upright position. The floor support 28 thus comprises a series of intervening linear portions 46, 48, 50, and 52 between the bend portions 40, 42 and 44 respectively. The bends 40, 42 and 44 provide a zigzag shape to the floor support 28 and permit the floor support 28 to remain upright without additional supports and to prevent the floor supports 28 from falling during assembly or usage. The bends 40, 42 and 44 can be of any angle which will provide upright stability to the floor support 28. In this particular embodiment, the bends 40, 42 and 44 have an angle of approximately 120 degrees. The number of the intervening portions and related bends may be varied, e.g. to form a two-sided V-shape, a three-sided Z-shape, etc. Also, the intervening portions may be curvilinear.

As shown in FIG. 3, each floor support 28 is comprised of several members or components. The upper rail member 60 is formed from an elongated strip of bar stock metal which is rectangular in cross-section. However, other materials with different cross-sectional configurations can be used, such as round stock. In one particular example, the upper rail member 60 has cross-sectional dimensions of $\frac{3}{8}$ inch in width and $\frac{1}{4}$ inch in height and a length of 74 inches prior to forming the bends 40, 42 and 44.

The floor support 28 also has vertical support members 66, a center horizontal support member 62 and a lower horizontal support member 64. Either the center horizontal support member 62 or the lower horizontal support member 64 can be eliminated from the design. However, the combination of both members provides additional rigidity to the floor support 28 for supporting heavy loads, and therefore is preferred, particularly for use in deep bins. The illustrated horizontal and vertical support members are made from metal rod stock with a circular cross-section. However, other materials with different cross-sectional configurations can be used. In the aforenoted particular example, the horizontal members have a diameter of $\frac{1}{4}$ inch and are approximately 74 inches in length, and the vertical members have a diameter of $\frac{3}{8}$ inch and are $11\frac{3}{4}$ inches or 17 inches in length depending upon the height of the floor support.

The horizontal members 62 and 64 are attached to the vertical members 66 at the intersections 68 and 70 of the horizontal and vertical members. In the illustrated embodiment, the horizontal members 62 and 64 are spot welded to the vertical members 66 at intersections 68 and 70. In addition, the upper rail member 60 is attached to the vertical members 66 at positions 72 on the recess portions 76 of upper rail member 60, and thus are located in or near alignment with the floor flanges 102 and 104 in the floor assembly. Alternatively, the vertical members 66 could be disposed beneath and attached to the upper rail member 60 at positions 74 on the ridge or crown portions 77 of the upper rail member 60, or at both locations for increased support. In the illustrated embodiment, the top of the vertical members 66 is spot welded to the bottom surface of the upper rail member 60.

As further shown in FIGS. 3, 4 and 6, the upper rail member 60 has a series of recesses 76 which receive the edge channels of the floor panels 26. The recesses 76 are created by a repeating pattern of bends 80, 84, 88 and 92 and linear portions 78, 82, 86 and 90.

In the illustrated example, the linear portions 78 and 82 of the upper rail form an angle of approximately 130 degrees at bend 80. The linear portions 82 and 86 also form an angle of approximately 130 degrees at bend 84. The linear portions 86 and 90 of the upper rail form an angle of approximately 130 degrees at bend 88. The linear portions 90 and 92 correspondingly form an angle of approximately 130 degrees at bend 92. However, the angles of the bends could vary and the type of recess could be made of a different configuration.

Referring to FIGS. 1 and 6, each floor panel 26 has a center plank portion 100 and a two subtending edge channels, one outwardly turned as at 102 and the other inwardly turned as at 104. Successive panels of this type are assembled and interlocked by placing the inwardly turned channel 104 of each panel 26 into the outwardly turned channel 102 of a preceding panel e.g., by placing the channel 104 of one panel 26 in channel 102 of a preceding panel and so on, progressing across the bin.

Other examples and arrangements of panels, such as C-shaped panels (two inwardly turned channels) and hat-shaped panels (two outwardly turned channels), used alone or in combination with the aforedescribed floor panels 26, and which may be used in floor assemblies including the hereindisclosed floor supports, are disclosed in U.S. Pat. No. 4,604,842 and in a copending application Ser. No. 84,692 filed Aug. 12, 1987.

The floor supports 28 are positioned below the panels 26 and engage the panels 26 at their respective outwardly turned channels 102 and engage the plank portions 100 therebetween. The edge channels 102 are positioned into the recesses 76 of the floor supports 28. Specifically, the outwardly turned channels 102 of the floor panels 26 engage the support surfaces 86 of the upper rail 60. The plank portions 100 of the floor panels 26 engage the support surface 78 of the upper rail 60. This engagement permits the load on the floor panels 26 to be transferred to support surfaces 78 and to support surfaces 86 on the upper rail 60. This dual engagement also prevents the central plank portions 100 from sagging or bending and also prevents the indentation or bending of the edge channels 102 under heavy load conditions.

However, if additional support is not required at the central plank portions 100, the plank portions 100 of the floor panels 26 do not have to engage the support surface 78 of the upper rail 60. Specifically, the outwardly turned channels 102 of the floor panels 26 engage the support surfaces 86 of the upper rail 60 and the plank portions 100 are at a measurable distance from the support surface 78.

In an exemplary installation in a round grain bin, the floor supports 28 are positioned in the grain bin as shown in FIG. 5. First, the floor supports 28 are positioned around the inside perimeter of the bin wall 120. Second, a floor support 28 is positioned along side of the unloading auger 122 and additional floor supports 28 are continued along the diameter of the bin to form the first row 124 of floor supports. The next row 126 of floor supports is positioned next to the first row 124 of floor supports. Additional rows of floor supports 28 are positioned in the bin in accordance with FIG. 5. The spacing between rows of floor supports will vary depending upon the bin diameter, the maximum grain depth and whether a recirculation device or continuous flow bottom unload system is used. Typical spacing is 8 to 16 inches between rows of floor supports. Finally, the floor panels 26 are positioned onto floor supports 28 as previously described herein.

While specific embodiments of the invention have been shown and described, it will be understood, of course, that the invention is not limited thereto since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope of the following claims.

What is claimed is:

1. A perforate grain bin floor support system for a supported floor having space therebeneath and comprising a series of elongated panels in edge-to-edge abutting relation to one another and a plurality of floor supports, each of said panels having a generally planar top portion and depending flanges along each longitudinal edge of said top portion, search floor support comprising an upper rail for supporting said floor panels, at least two vertical members extending from said upper rail to the foundation of the bin, at least one horizontal member attached to the vertical member and disposed between the upper rail and the base of the bin, said upper ail being a unitary component of substantially uniform cross-section and having at least a portion which is of a corrugated configuration thereby defining a plurality of recesses and crowns between the recesses, the depth and spacing of said recesses along said rail being such that said panels are supported by engagement of the recesses of the upper rail against said depending flanges whereby a plurality of panels are supported by a single floor support.

2. The invention as in claim 1 wherein said vertical members are disposed beneath and attached to the underside of the upper ails at each of said recesses.

3. The invention as in claim 1 wherein said vertical members are disposed beneath and attached to the underside of the upper rails at each of said ridges or crowns of the upper rail.

4. The invention as in claim 1 wherein said vertical members are disposed beneath and attached to the underside of the upper rails at each of said recesses and at each of said crowns of the upper rail.

5. The invention as in claim 1 wherein said floor support has two horizontal members attached to said vertical members and disposed between the upper rail portion and the base o the bin.

6. The invention as in claim 1 wherein said vertical members have a circular cross-section.

7. The invention as in claim 1 wherein said horizontal member has a circular cross-section.

8. The invention as in claim 1 wherein said upper rail has a rectangular cross-section.

9. The invention as in claim 1 wherein said vertical members are attached to said horizontal members and said upper rail by spot welding.

10. The invention of claim 1 where each of said top portions is perforate to permit the passage of air therethrough and each of said flanges engaging in nesting relation with the respective adjacent flange of the adjacent panel.

11. The invention as in claim 1 wherein each of said floor supports is of an offset configuration in plan whereby each of said floor supports will remain erect without additional supports.

12. The invention as in claim 1 wherein each of said floor supports is of zig-zag shape in plan.

13. A grain bin floor support for supporting floor panels each having a generally planar top portion and depending flanges along each longitudinal edge of said top portion, said floor support comprising an upper rial for supportably engaging such floor panels, at least two vertical members, for extending from said upper rail to the foundation of the bin, at least one horizontal member attached to the vertical members and disposed between the upper rail and the lower end of said vertical members, said upper rail being a unitary component of substantially uniform cross-section and having at least a portion which is of a corrugated configuration thereby defining a plurality of recesses and crowns between he recesses, the depth and spacing of said recesses along said rail being such that said panels are supported at least in part by engagement of the recesses of the upper rail against said depending flanges, whereby a plurality of such panels may be supported by a single floor support.

14. The invention as in claim 13 wherein said vertical members are disposed beneath and attached to the underside of the upper rails at each of said recesses.

15. The invention as in claim 13 wherein said vertical members are disposed beneath and attached to the underside of the upper rails at each of said ridges or crowns of the upper rail.

16. The invention as in claim 13 wherein said vertical members are disposed beneath and attached to the underside o the upper rails at each of said recesses and at each of said crowns of the upper rail.

17. The invention as in claim 13 wherein said floor support has two horizontal members attached to the vertical members and disposed between the upper rail portion and the lower ends of said vertical members.

18. The invention as in claim 13 wherein said vertical members have a circular cross-section.

19. The invention in claim 13 wherein said horizontal member has a circular cross-section.

20. The invention as in claim 13 wherein said upper rail has a rectangular cross-section.

21. The invention as in claim 13 wherein said vertical members are attached to said horizontal members and said upper rail by spot welding.

22. The invention as in claim 13 wherein each of said floor supports is of an offset configuration in plan whereby each of said floor supports will remain erect without additional supports.

23. The invention as in claim 13 wherein each of said floor supports is of zig-zag shape in plan.

24. A perforate grain bin floor support system for a supported floor having space therebeneath and comprising a series of elongated panels in edge-to-edge abutting relation to one another and a plurality of floor supports, each of said panels having a generally planar top portion and depending flanges along each longitudinal edge of said top portion, each floor support being formed of bar stock components each of substantially uniform cross-section configuration throughout its length and comprising an upper support portion for supporting said floor panels, at least two vertical members extending from said upper support portion to the foundation of the bin, at least one horizontal member attached to the vertical members and disposed between the upper support portion and the base of the bin, said upper support portion defining a plurality of recesses and crowns between the recesses, each of said crowns being formed by a portion of said bar stock components deformed transverse to its length into such crown configuration, the depth and spacing of said recesses along said support portion being such that said panels are supported by engagement of the recesses of the upper support portion against said depending flanges whereby a plurality of panels are supported by a single floor support wherein said upper support portion is defined by one of said bar stock components which is of a corrugated configuration along its entire length to define said crowns and recesses of the respective floor support.

25. The invention as in claim 24 wherein said floor support has at least one vertical bend.

26. The invention as in claim 25 wherein said vertical bend has an angle of about 120 degrees.

27. The invention as in claim 24 wherein said recesses and crowns between he recesses are created by a repeating pattern of bends and linear portions.

28. The invention as in claim 27 wherein said bends have an angle of about 130 degrees.

29. The invention as in claim 24 wherein said crowns engage the underside of the planar top portion of said panels.

30. A grain bin floor support for supporting floor panels each having a generally planar top portion and depending flanges along each longitudinal edge of said top portion, said floor support being formed of bar stock components each of substantially uniform cross-sectional configuration throughout its length and comprising an upper support portion for supportably engaging such floor panels, at least two vertical members for extending from said upper support portion to the foundation of the bin, at least one horizontal member attached to the vertical members and disposed between the upper support portion and the lower ends of said vertical members, said upper support portion defining a plurality of recesses and crowns between he recesses, each of said crowns being formed by a portion of said bar stock components deformed transverse to its length into such crown configuration, the depth and spacing of said recesses along said support portion being such that said panels are supported by engagement of the recesses o the upper support portion against said depending flanges, whereby a plurality of such panels may be supported by a single floor support wherein said upper support portion is defined by one said bar stock components which is of a corrugated configuration along its length to define said crowns and recesses of the respective floor support.

31. The invention as in claim 13, 17, 19, 30, 22 or 23 wherein said floor support has at least one vertical bend.

32. The invention as in claim 31 wherein said vertical bend has an angle of about 120 degrees.

33. The invention as in claim 13, 17, 19, 30, 22 or 23 wherein said recesses and crowns between the recesses are created by a repeating pattern of bends and linear portions.

34. The invention as in claim 33 wherein said bends have an angle of about 130 degrees.

35. The invention as in claim 13, 17, 19, 30, 22 or 23 wherein said crowns engage the underside of the planar top portion of said panels.

* * * * *

UNITED STATES PATENT AND TRADEMARK OFFICE

CERTIFICATE OF CORRECTION

PATENT NO. : 5,107,644

DATED : April 28, 1992

INVENTOR(S) : John A. Hanig

It is certified that error appears in the above-identified patent and that said Letters Patent is hereby corrected as shown below:

Column 5, line 68, delete "search" and substitute therefor --each--

Column 6, line 4, delete "member" (second occurrence) and substitute therefor --members--

Column 6, line 6, delete "ail" and substitute therefor --rail--

Column 6, line 17, delete "ails" and substitute therefor --rails--

Column 6, line 29, delete the word "o" and substitute therefor --of--

UNITED STATES PATENT AND TRADEMARK OFFICE

CERTIFICATE OF CORRECTION

PATENT NO. : 5,107,644

DATED : April 28, 1992

INVENTOR(S) : John A. Hanig

It is certified that error appears in the above-identified patent and that said Letters Patent is hereby corrected as shown below:

Column 6, line 53, delete "rial" and substitute therefor --rail--

Column 7, line 10, delete the word "o" and substitute therefor --of--

Column 7, line 39, delete "cross-section" and substitute therefor --cross-sectional--

Column 8, line 29, delete "he" and substitute therefor --the--

Column 8, line 35, delete the word "o" and substitute therefor --of--

Signed and Sealed this

Third Day of August, 1993

*Attest:*

Michael K. Kirk

MICHAEL K. KIRK

*Attesting Officer*

*Acting Commissioner of Patents and Trademarks*